United States Patent [19]

Tice et al.

[11] 4,429,477

[45] Feb. 7, 1984

[54] PORTABLE DITCHER AND EXCAVATING ELEMENTS THEREFOR

[75] Inventors: Bernard O. Tice, St. Marys; Gene E. Bailey, Parkersburg, both of W. Va.

[73] Assignee: Ditcher Saw Company, St. Marys, W. Va.

[21] Appl. No.: 172,653

[22] Filed: Jul. 28, 1980

[51] Int. Cl.[3] ..... E02F 5/06

[52] U.S. Cl. ..... 37/80 R; 37/191 A; 172/100; 299/82

[58] Field of Search ..... 37/80 R, 191 A, 191 R, 37/192, 86, 83, 142 R, 2 R, 80 A; 299/82–84; 172/100

[56] References Cited

U.S. PATENT DOCUMENTS

| | | | |
|---|---|---|---|
| 2,709,860 | 6/1955 | Helton | 37/142 R X |
| 2,991,571 | 7/1961 | Hyster | 37/191 A |
| 3,050,881 | 8/1962 | Brown | 37/191 A X |
| 3,054,198 | 9/1962 | George et al. | 37/191 A X |
| 3,104,481 | 9/1963 | George et al. | 37/191 A X |
| 3,593,804 | 7/1971 | Snider | 37/191 A X |
| 3,614,838 | 10/1971 | Wherry | 37/2 R |
| 3,846,922 | 11/1974 | Horton | 37/191 A |
| 3,913,979 | 10/1975 | Strauss | 299/84 |

FOREIGN PATENT DOCUMENTS

| | | | |
|---|---|---|---|
| 968376 | 5/1975 | Canada | 37/191 A |
| 599010 | 3/1978 | U.S.S.R. | 37/191 A |
| 604922 | 4/1978 | U.S.S.R. | 37/191 A |

*Primary Examiner*—E. H. Eickholt

*Attorney, Agent, or Firm*—Colton & Stone, Inc.

[57] ABSTRACT

The disclosure is primarily directed to the reduction of excavating tooth and chain drag which makes possible the manual transport and manual propulsion of a ditcher through the earth to commercially acceptable specifications.

7 Claims, 9 Drawing Figures

PORTABLE DITCHER AND EXCAVATING ELEMENTS THEREFOR

BACKGROUND OF THE INVENTION

The disclosure introduces a new concept in commercially practicable ditching machines; that of the manually portable and manually propelled endless chain trencher.

The problems addressed in the actual commercial production of a truly portable trencher derive from limitations that are not present in conventional trenchers. The most obvious is weight which, in turn, is a function of that power plant limitation that has previously defeated the trenching depth and speed requirements of a commercially acceptable, portable ditcher. Thus, the design considerations which allow considerable latitude in the choice of an endless chain digger tooth configuration adapted for recirculation by a power plant of virtually unlimited horsepower and/or adapted for powered propulsion through the earth are quite different from one adapted for manual transport and manual propulsion through the earth. The difference is one of tooth element configuration conforming to power plant capacity as opposed to selection of a desired horsepower rating to recirculate a desired tooth configuration.

The distinction is simply stated but is fully explanatory of the reason why the portable ditcher herein disclosed, which is in commercial use in virtually every major country in the world, has had no commercial predecessor.

The expression "portable ditcher" as used herein refers to that size and weight ditcher that can be both manually carried for transport and manually propelled through the earth during a trenching operation. As will be apparent, an overall unit weight exceeding much over fifty pounds would not be consistent with this truly portable aspect for ready transport and extended trenching operations by the average person.

Considering the weight constraints of the overall unit including the gear box and cutter bar the size power plant that can be employed translates to a power rating in the range of 3–3½ horsepower. Typical trenching depths for various pipe and cable laying operations vary from 6 to 18 inches with some depth requirements approaching two feet. With sufficient power plant capacity there is, of course, no difficulty in digging a relatively narrow trench, as on the order of 2–3 inches, to these depths. The problem arises when the task is sought to be accomplished, at commercially acceptable speeds, with a small power source such as a 3 horsepower chain saw motor, for example.

The key to the successful employment of small power sources of the type described for trenching at eminently acceptable commercial speeds of 10–20 feet per minute, depending upon soil conditions, is drag reduction; primary emphasis is on tooth drag and secondary emphasis on chain drag.

Prior art attempts to produce relatively small ditchers have, for the most part, employed chain and tooth configurations quite suitable for recirculation by a large power source but have made little if any concessions to such design as would enable the same to function effectively with small power plants of the type herein contemplated. Exemplary are the disclosures in U.S. Pat. Nos. 2,991,571 and 3,054,198.

In general, dynamic tooth drag, per se, varies inter alia, with:

(1) tooth size, (2) lateral working angle of attack, (3) trailing surface area configuration in earth contact, and (4) tooth tracking alignment while chain drag is primarily a function of lateral force components, imparted by the teeth, tending to offset the chain from a straight run as well as actual chain engagement with an uncut central seam and, secondarily, of frictional contact with the cutter bar and excessive tensioning due to sprocket fouling.

A partial solution to the problem of excessive tooth drag to the extent of employing relatively small teeth having a small lateral angle of attack appears in U.S. Pat. No. 3,614,838 which is assigned to the owner of the present invention in the actual use of which, however, unacceptably high drag forces are imposed by the trailing surface area configurations of the teeth.

Until the introduction of the present ditcher, the weight of the smallest, narrow trenching equipment commercially available for pipe and cable laying has been measured in hundreds of pounds the weight of which not only requires trailerable transport but insures the potential for surface damage in certain trenching environments such as, for example, wheel track indentations in residential lawns during sprinkler system installation. In contrast, since the present ditcher weighs well under fifty pounds it is equally adaptable for hand-held use or mounting to a small hand-propelled dolly allowing the operator to remain upright during trenching operations.

Another feature of the invention is the ready convertability of the ditcher from a hand-held use mode to a dolly-supported condition requiring nothing more than a two bolt assembly for stable securement.

With the power source necessarily adjacent the exhaust end of the chain run the otherwise short working life of the intake filter is substantially extended, in the dolly-mounted mode, by the use of a second, series connected filter positioned upstream of the engine mounted filter and supported at a location remote from the chain run.

SUMMARY OF THE INVENTION

The heart of the invention is the digger tooth configuration and the particular mode of mounting to the chain which reduces cumulative drag to such an extent that a small, hand-held power source, as on the order of 3 horsepower, can trench to commercially acceptable specifications with manual propulsion through the earth, i.e. a 2½" wide trench to depths in excess of 18" at speeds of 10 to 20 feet per minute depending upon soil conditions. It must be borne in mind that when working with a very small power source, which is critical to the attainment of the objective herein—a truly portable ditcher; even a small reduction in tooth drag when multiplied by the entire tooth run of, for example, 26 teeth can make the critical difference between a ditcher which will or will not perform to commercial specifications.

The major cause of eliminatable tooth drag, per se, is contact with unexcavated earth by non-excavating portions of the tooth. Ideally, only that sharpened portion of the tooth designed to perform an excavating function should contact virgin earth with the remainder of the tooth body contacting only previously cut material.

Since the chain and teeth are constantly undergoing lateral vibration during a trenching operation the ideal condition is obviously not met where the leading, excavating tooth edge or point is aligned with some or all of the remainder of the tooth body in a plane parallel to the plane of the chain run because such remainder of the tooth body will be in vibrating contact with the outer trench wall. Similarly, if the lower tooth wall is not relieved sharply, aft of the excavating portion of the tooth, it will be riding in contact with the virgin bottom of the advancing trench front rather than merely moving through previously excavated material. A third area of virgin tooth contact is the central seam remaining between the laterally spaced cutter tooth runs. In the width size trench herein contemplated this latter area is of little concern if one is ditching under ideal conditions such as in sandy loam, for example, because that portion of the cut centrally of the excavating teeth will simply collapse. In most cases, however, and particularly in hard pan, a central seam remains as virgin material and, if contacted by a non-excavating portion of the tooth, produces a magnitude of tooth drag greater than either of the first two mentioned causes since the result is to actually remove the virgin seam as opposed to sliding contact with uncut material.

The first of the virgin contact problems, that of lateral contact, is solved by so forming the tooth that the leading cutting portion thereof, herein a pair of sharpened cutting edges defining a leading excavating point, makes a small, lateral angle of attack with respect to the plane of the chain run. The remainder of the tooth body is thus inboard of the excavating portion and encounters only cut material. The training end of the tooth terminates in an inwardly angled tail portion which is opposite to and of approximately the same angular magnitude as the leading angle of attack. The inwardly angled tail portion extends only slightly into the path of the chain run, preferably not past the plane of the inner chain link, and substantially less than one fourth the way thereacross to insure that this non-excavating portion of the tooth does not fully engage the central seam. The purpose of the angled tooth is twofold, to help balance twisting torques imposed on the tooth from the leading, excavating end and to convey excavated material to the surface.

The second contact problem, that of tooth bottom contact, is reduced by forming the tooth bottom with a substantial upward rake immediately aft of the leading cutting portion. The magnitude of this rearward rake angle is such that the extent of the tooth body extending below the chain is reduced by approximately one half from the forward to the trailing end of the tooth.

Central seam removal, the third tooth contact problem as well as a substantial chain contact problem, is solved by simply reversing two of the recirculating teeth at spaced positions along the chain run. Thus one left hand tooth is mounted on the right side of the chain and one right hand tooth is mounted on the left side of the chain. The result is two teeth, at spaced positions along the chain run, whose excavating portions lie along the center line of the chain for seam removal. The advantages in being able to use the same teeth, simply mounted in reverse, to effect seam removal include reduced field inventory and production costs. The foregoing necessarily implies that the lateral extent of the excavating point relative to the side chain mounting is approximately one half the chain width.

The right and left hand teeth are mirror images of each other and have respectively identical mountings to opposite sides of the chain run which insures maximum identity of tooth tracking within those constraints necessarily imposed by inherent chain vibration.

The particular size tooth herein disclosed as being mounted on a $\frac{3}{4}''$ wide roller chain having links which are $1\frac{1}{8}''$ long and $\frac{1}{2}''$ wide represents the maximum size advantage for continual trenching advance and is shown to have an overall body length approximately equal to two chain links with a maximum depth extension below the chain run, measured at the excavating point, of between $1\frac{1}{2}$ and 2 times the chain thickness.

Chain drag, per se, derives primarily from seam engagement as previously discussed and friction with the cutter bar as well as overtensioning, frequently due to sprocket fouling. Cutter bar friction is, in accordance with the present invention, virtually eliminated by the use of Teflon wear plates underlying the chain run. Sprocket fouling, which is particularly prevalent in small power trenchers because the size, weight and power of the equipment is not sufficient to simply disintegrate any fouling material, is ameliorated in two ways; by employing a spring loaded sprocket at the idle end of the cutter bar to allow "back off" and self-clearing under load and recessing the sprocket teeth roots to form cutting edges to coact with the chain rolls to cut through fouling material.

A major feature of the invention is the ready convertability of the trencher herein disclosed from the hand-held to a dolly-supported trenching mode.

Advantage is taken of the cross bar handle support used to carry the trencher in effecting a stable, dolly-mounted support requiring nothing more than a two bolt assembly in such fashion as to lock the cross bar handle against a raised axle, interconnecting the dolly wheels, to provide a stable triad mounting.

The power plant and gear reducer are suspended from the raised axle through the intermediary of a horizontally disposed U-shaped support arm, the aft end of whose upper limb is journalled on the raised axle while the aft end of the lower limb is bolted to an exhaust housing integral with the power source and gear reducer. The result is to suspend the majority of the trencher weight immediately adjacent ground level between the transport wheels. This mounting arrangement, considered with a forwardly extending operator hand and the rearwardly extending cutter bar results in an assembly whose center of gravity is substantially aligned with the axis of wheel rotation. Tilting of the cutter bar about the raised axle during trenching operations is effected by an operating handle assembly connected to the forward, bight end of the U-shaped support arm and selectively operable from the upper end of the operator handle.

DESCRIPTION OF THE PREFERRED EMBODIMENTS

Figure 1:
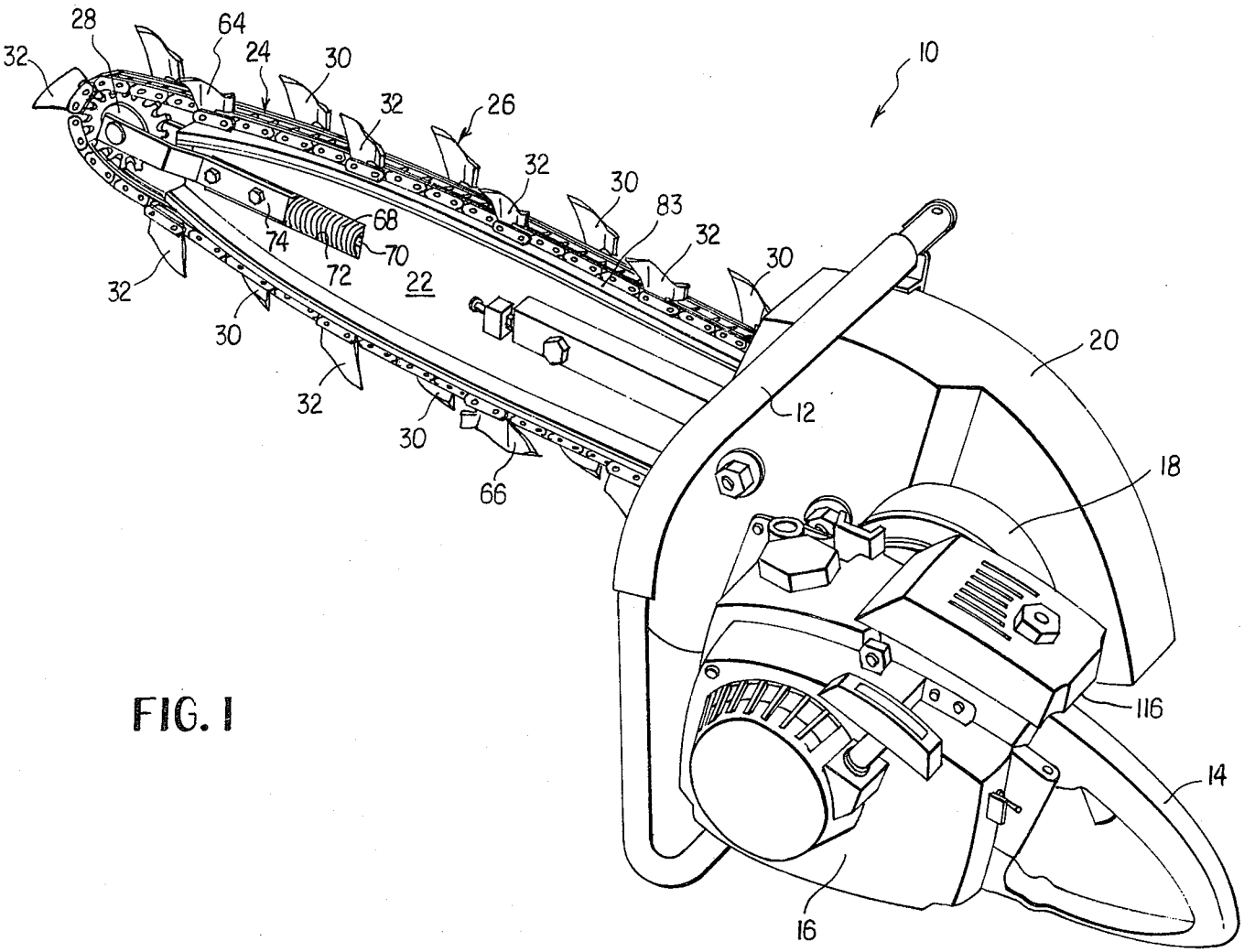
FIG. 1 is a perspective view of a portable ditcher adapted for hand-held propulsion through the earth.

In FIG. 1 is illustrated a portable ditcher 10 adapted for hand propulsion through the earth via the intermediary of cross bar handle 12 and a handle 14 positioned forwardly of the ditcher considered in the direction of trenching movement. Ditcher 10 includes a power transmission unit comprising a conventional chain saw power source 16 and a gear reducer 18 which are integral with exhaust guide housing 20. A drive sprocket, not shown, positioned at the forward end of cutter bar 22 is driven through gear reducer 18 in the usual fashion to recirculate roller chain 24 and excavating teeth 26 about the center bar and forward idler sprocket 28.

It is the reduction in cumulative drag, and particularly cumulative tooth drag, that makes possible recirculation of the teeth through the earth to commercial specifications, as previously described, by a small power source of that weight which can be readily employed for manual operations.

Figure 2:
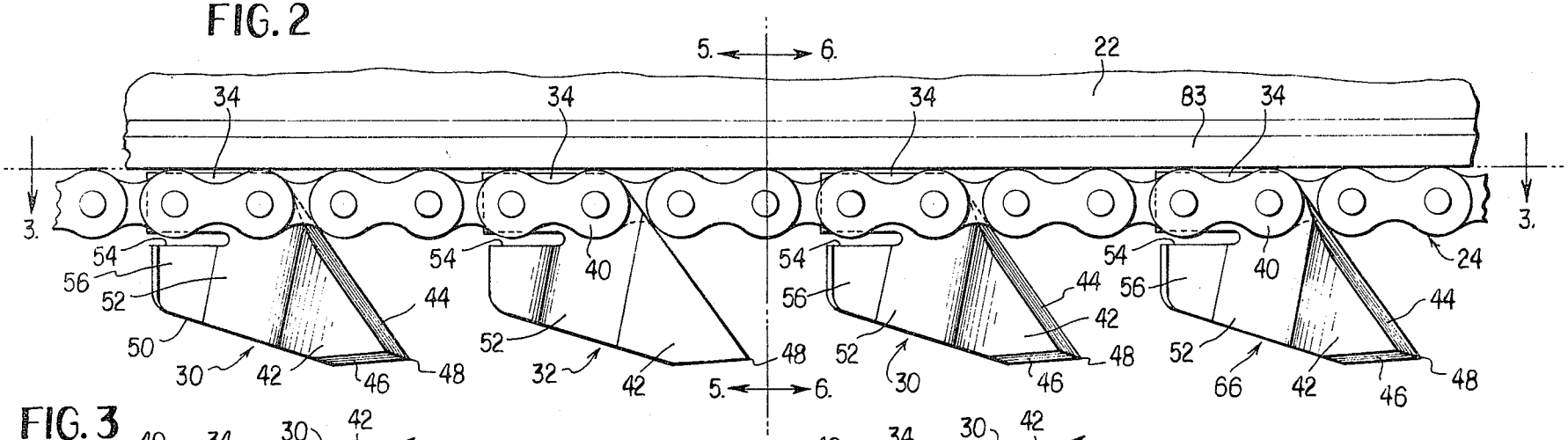
FIG. 2 is an enlarged elevational view, to actual size, of a portion of the lower excavating chain run of FIG. 1.
Figure 3:
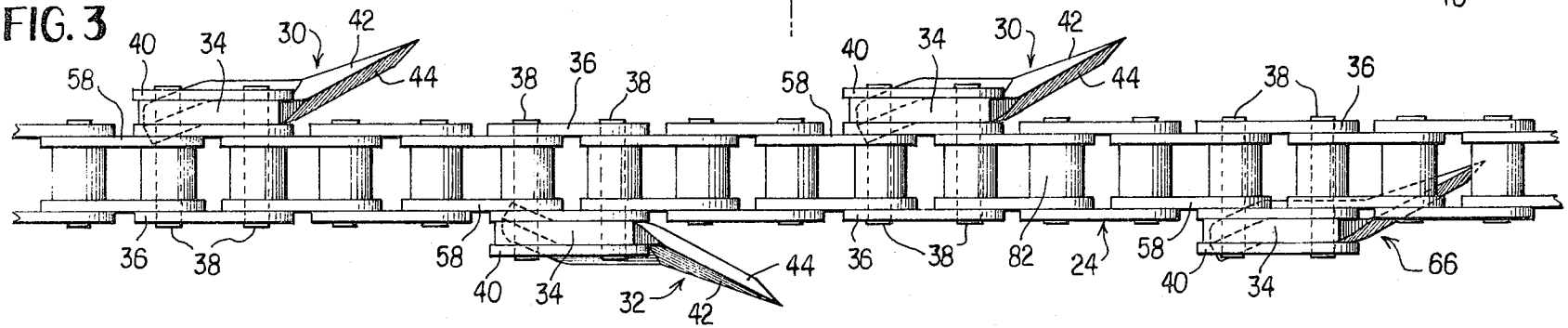
FIG. 3 is a top plan view of FIG. 2.
Figure 4:
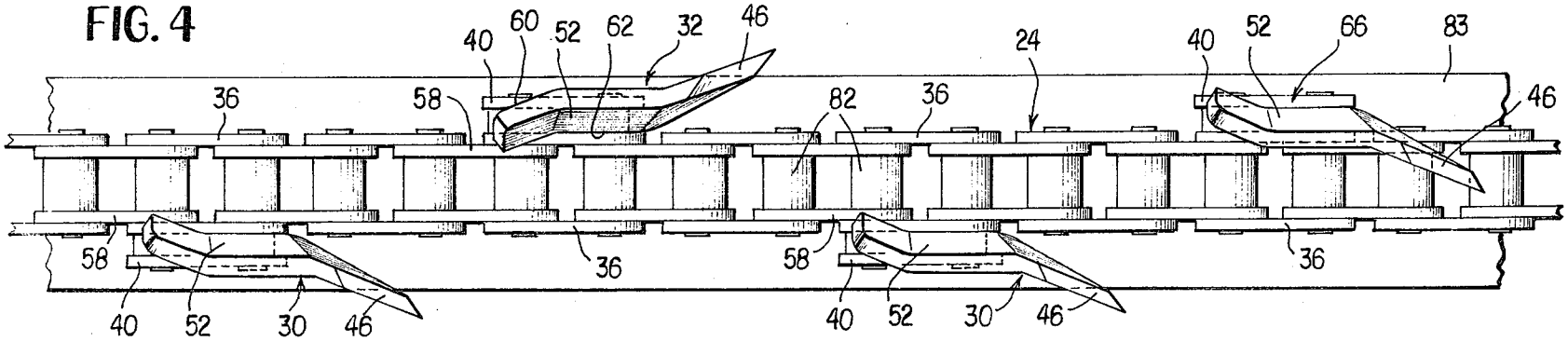
FIG. 4 is a bottom plan view of FIG. 2.

The details of the excavating teeth and their orientation on chain 24 are shown in FIGS. 2–6. Excavating teeth 26 are made up of right hand teeth 30 and left hand teeth 32 that are mirror images of each other and are mounted, in alternating fashion, to the right and left sides, respectively, of chain 24 as viewed, for example, along the upper run of FIG. 1. Each tooth 26 includes an upper (as viewed along the lower chain run of FIG. 1 and as illustrated in FIG. 2) straight body portion 34 appropriately apertured for mounting to the chain in the usual position of an outer link 36 through the intermediary of pins 38 and locking links 40. The leading cutting portion 42 of each tooth extends downwardly, forwardly and outwardly from body portion 34 defining a small, lateral angle of attack with respect to the plane of the chain run. Inasmuch as cutting portion 42 is defined by upper and lower sharpened cutting edges 44, 46 terminating at a leading excavating point 48 it will be apparent that the excavating portions of the teeth define the outer lateral limits of the recirculating run while the non-excavating portions of the teeth are all inboard thereof but limited to lie within the kerf width to be cut by the tooth as will be subsequently explained, thus insuring against drag inducing contact with the outer, lateral trench walls.

The bottom wall 50 of lower tooth body portion 52 extends rearwardly and upwardly at a substantial angle from its forward merger with lower cutting edge 46, as best shown in FIG. 2, for the purpose of reducing drag inducing contact with the trench bottom.

Lower tooth body portion 52 is slotted at 54, just below the straight tooth mounting portion 34, and the trailing end 56 of body portion 52 is angled inwardly of the chain run to terminate just within the plane of an inner chain link 58 as illustrated in FIGS. 3–6. In terms of reference to the tooth body, per se, the inward extent of the trailing end 56 may be defined in terms of the fact that substantially all the outer surface 60 of trailing end 56 lies laterally outward of the inner surface 62 of the straight tooth mounting portion 34. This limitation of the inward extent of the trailing end assures against substantial central seam engagement while yet insuring efficient elevation of excavated earth. The inward angle made by trailing end 56 relative to the straight tooth mounting portion 34 is approximately the same as the outward, lateral angle of attack exhibited by the excavating portion 42. While the primary purpose of the inwardly angled trailing end 56 is to carry cut material to the surface it also relieves tooth twisting torque, applied at the forward excavating end of the tooth, to reduce chain vibration with a consequent reduction in chain drag. It is critical that the trailing end 56 terminate well short of any substantial chain overlap because the effect of its full engagement with an uncut central seam acts as a brake on the equipment which is fatal to attempted trenching operations in certain type soils, most notably hard pan, when using a small power source. The extent of the dynamic inward reach of trailing end 56 during a ditching operation is determined by the natural lateral vibration undergone by an excavating chain run which, of course, produces a tooth cut which is wider than the width of the excavating end of the tooth. While a chain overlap by trailing end 56 slightly beyond the plane of inner links 58 can be tolerated in certain soils the more limited extent, just described, is critical for trenching over a wide range of soils.

Figure 6:
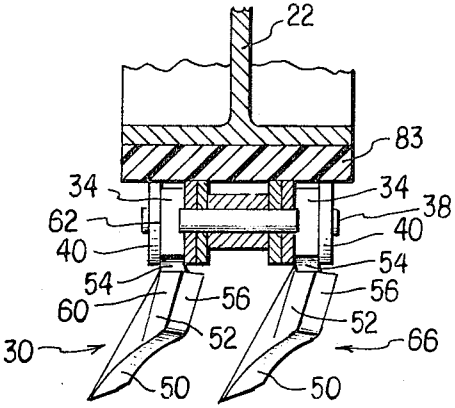
FIG. 6 is a cross-sectional view taken along line 6—6 of FIG. 2.
Figure 5:
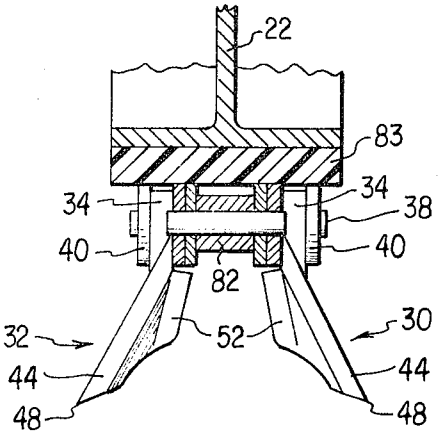
FIG. 5 is a cross-sectional view of the excavating chain taken along line 5—5 of FIG. 2.

Removal of the central seam is effected by mounting one each of the right and left hand teeth 30, 32 to the left and right sides, respectively, as indicated by the reverse mounted right and left hand teeth 64, 66 at spaced locations along chain 24. As best seen in FIG. 6, the result of reversing the tooth mounting is to position the excavating point along the center line of the chain run since the lateral offset of an excavating point 48 from the straight body mounting portion 34 is approximately equal to one half the chain width. With two of the teeth so reversed, seam removal is effected by the reversed teeth rather than by the chain 24, itself, as would be the case in the absence of the reversed teeth.

Returning now to details of the overall trencher as shown in FIG. 1, idler sprocket 28 is spring biased to the full tension position illustrated by a compression spring 68 reacting between a mounting stud 70 at the forward end of cutter bar recess 72 and a slidably mounted sprocket support bracket 74 at the rearward end of the recess. Sprocket fouling, as by caked earth or other fouling material, is dynamically relieved by back off of the idler against the bias of spring 68.

Figure 7:
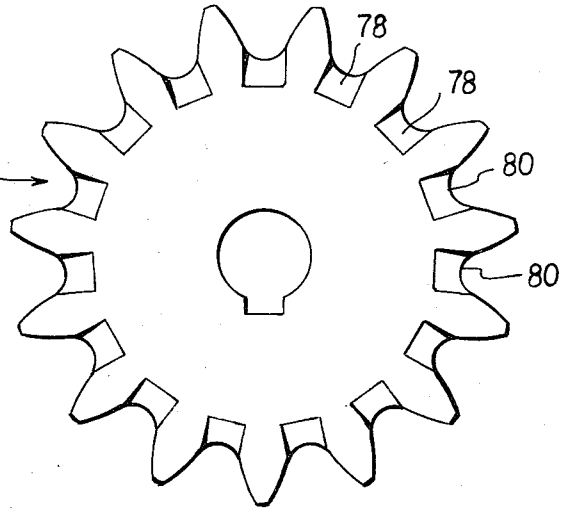
FIG. 7 is an enlarged view of an alternate idler sprocket construction for the trencher shown in FIG. 1.

Sprocket fouling may also be relieved by use of the idler sprocket 76, shown in FIG. 7, whose tooth roots are relieved as at 78 to produce arcuate cutting surfaces 80 which coact with chain rollers 82 to sever fouling material. Either or both of the anti-fouling devices just described may be used with the portable trencher 10 whose cutter bar 22 includes Teflon wear strips 83 underlying the chain run.

In use, the portable ditcher 10 is manually supported by cross bar handle 12 and forward handle 14 and manually propelled through the earth by a crouching operator moving backward with the cutter bar 22 downwardly directed to the desired depth and the lower excavating chain run delivering excavated earth to the surface via exhaust housing 20.

Figure 8:
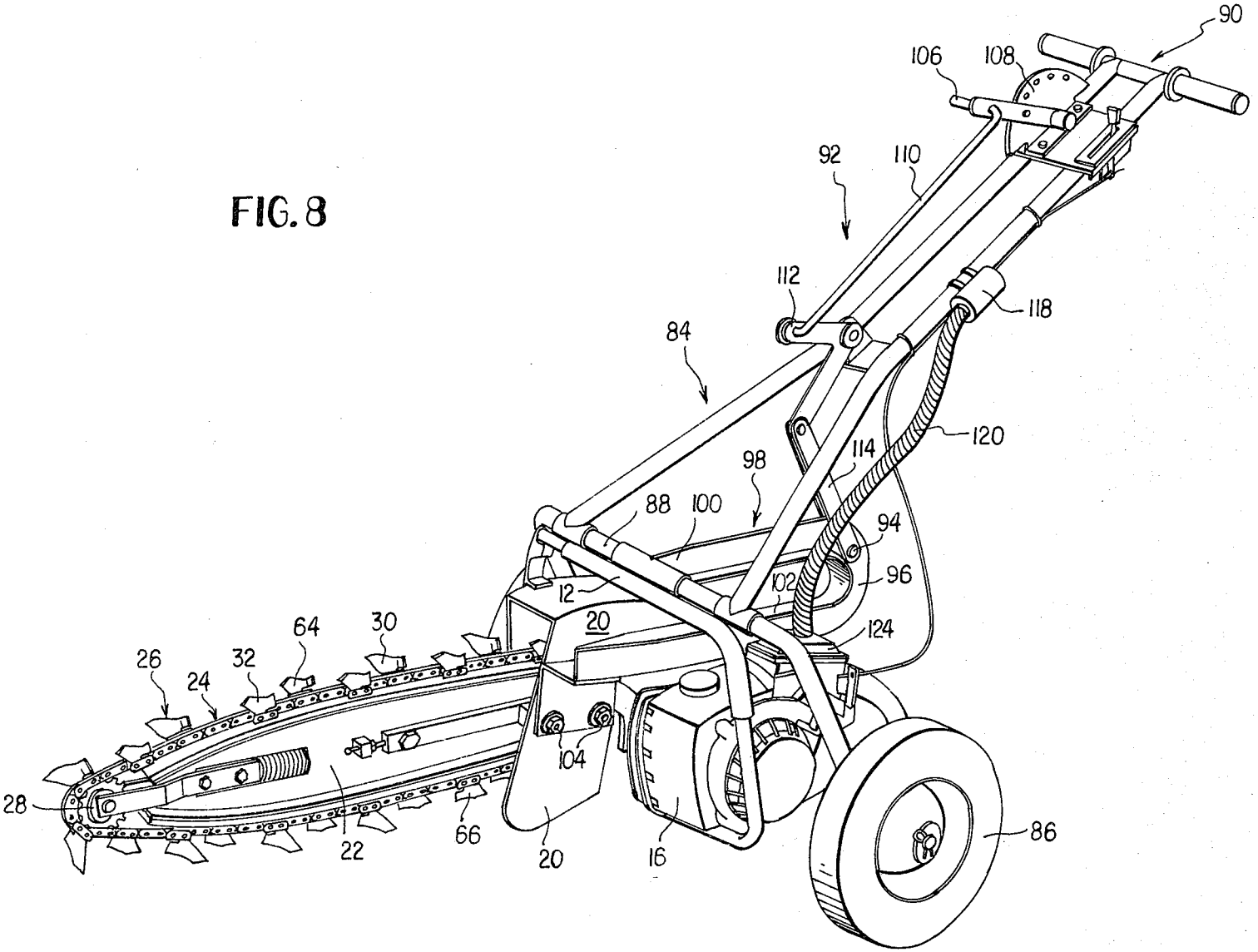
FIG. 8 is a perspective view of a dolly-supported portable trencher.

Portable ditcher 10 is adapted for removable mounting to a two wheeled dolly 84, as shown in FIG. 8, to convert the same from a hand-held to a dolly-supported trenching mode.

Dolly 84 includes a pair of ground support wheels 86 having an interconnecting raised axle portion 88 lying well above the axis of wheel rotation. An operator handle 90 extends upwardly and forwardly from raised axle 88 and supports an operating mechanism 92 pivotally interconnected at 94 with the forward bight end 96 of a horizontally disposed U-shaped support arm 98 through the intermediary of which, portable ditcher 10 is suspended from raised axle 88 for selective arcuate movement thereabout. The rearward end of upper limb 100 of support arm 98 is journalled on raised axle 88 while the aft end of the lower limb 102 is rigidly secured to the exhaust housing 20 and cutter bar 22 of ditcher 10 by mounting bolts 104 to support the major trencher weight generally along the axis of wheels 86. The horizontal length of cross bar handle 12 is maintained in stabilizing engagement with raised axle 88 of dolly 84 by virtue of the mounting positions of bolts 104.

In operation, following transport of the dolly-supported ditcher to a work site with the cutter bar in the raised transport position as shown in FIG. 8, hand lever 106 of the operating mechanism 92 is moved forwardly to a selected setting on quadrant 108 to tension rod 110, rotate bell crank 112, tension connecting link 114 and swing support arm 98 counter clockwise, as viewed in FIG. 8, to lower the aft end of cutter bar 22. This operation is repeated in step wise fashion until the initial cut is to the desired depth. Thereafter, the operator walks backward pulling the dolly along the ground and the cutter bar through the earth.

Figure 9:
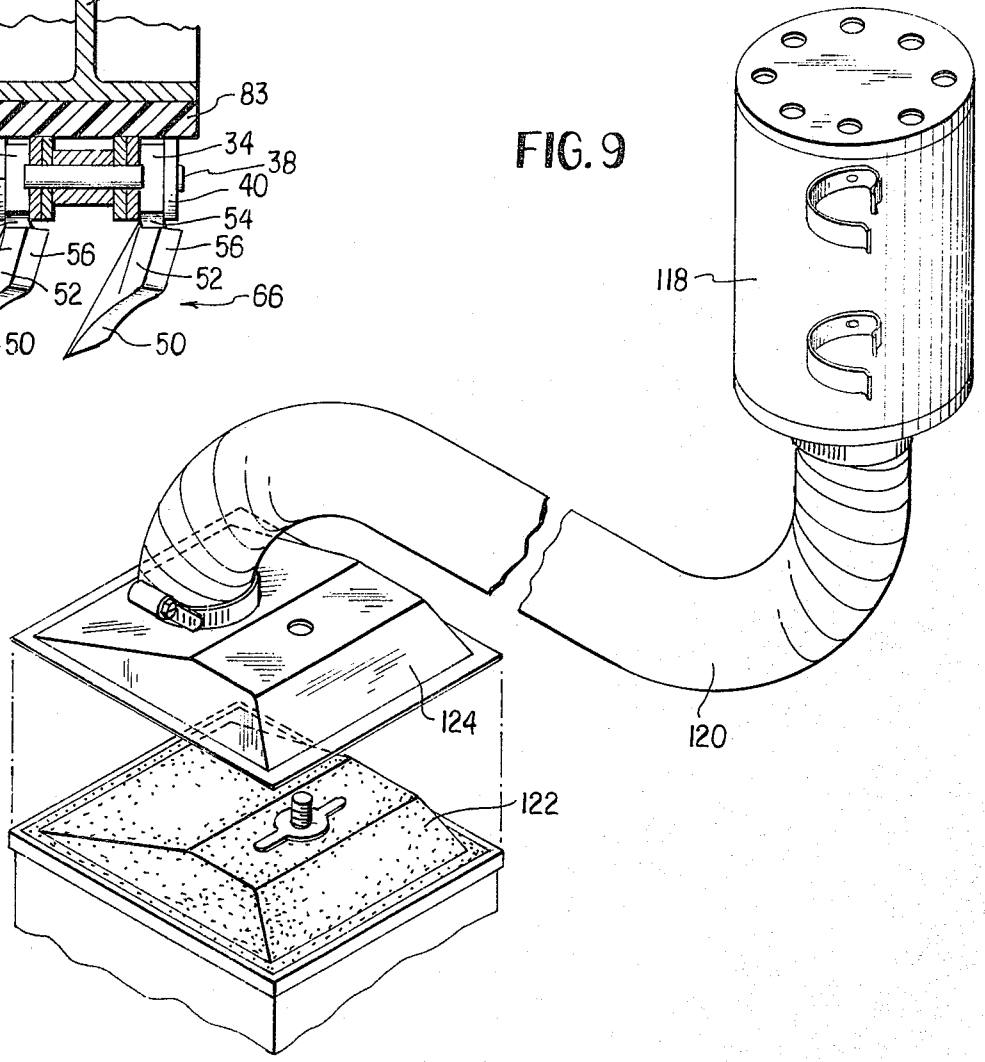
FIG. 9 is an exploded view of the series connected intake filter for the chain driving power source.

During operation of the trencher 10 in either the hand-held or dolly-supported mode the excavated material is brought to the surface at and in advance of the exhaust housing 20 which is closely adjacent power source 16 and its air intake 116 which necessitates frequent changing of the intake filter. In the dolly-supported mode, intake filter life is greatly extended by positioning the same at a remote location relative to the power source such as illustrated by filter housing 118 secured to operator handle 90 and connected with air intake 116 by hose 120. In a preferred embodiment, as fragmentarily illustrated in FIG. 9, the usual engine carried filter 122 is retained but the usual intake housing is removed and an intake housing 124, which is sealed with respect to ambient air ingress, is substituted therefor. Hose 120 is then interconnected between upper filter 118 and sealed intake housing 124 resulting in an air intake through series connected filters whose ambient intake is remote from the excavated material.

We claim:

1. A portable trencher having a cutter bar supporting an excavating chain run in driving engagement with a power transmission unit rigid with said cutter bar and including operator support handles fore and aft of said unit; a plurality of right hand teeth secured to one side of said chain in alternating relation with a plurality of left hand teeth secured to the other side of said chain; said right and left hand teeth being mirror images of one another; each of said teeth including a straight, upper mounting portion and a lower earth engaging portion; said lower earth engaging portion including a forward excavating portion extending laterally outward of said chain and mounting portion to terminate in a leading excavating point defining the lateral most extent of the tooth outwardly of said chain; the trailing end of said lower earth engaging portion of each of said teeth extending laterally inwardly of said upper mounting portion to terminate in a plane of the following inner chain link; an additional right hand tooth secured to the said other side of said chain and an additional left hand tooth secured to said one side of said chain; and, in combination with said trencher, a two-wheeled dolly; and means, including one of said operator support handles, for stably mounting said trencher on said dolly for trenching operations.

2. The portable trencher of claim 1 wherein said dolly includes a horizontal raised axle portion; said last named means including removable fastener means for maintaining said operator support handle in engagement with said raised axle portion; and means suspending said portable trencher from said raised axle for selective arcuate positioning thereof about the axis of said raised axle portion.

3. A portable trencher having a unitary driving and support unit including power transmission means and an exhaust housing rigidly mounting a cutter bar in fixed relation thereto and in driving engagement with an excavating chain supported on said cutter bar; operator support handles adjacent opposite ends of said driving and support unit including a crossbar handle overlying said exhaust housing adjacent the aft end of said unit; a two wheeled dolly having a raised axle wheel support and an operator handle extending upwardly and forwardly thereof; and means suspending said portable trencher from said raised axle for selective arcuate posistioning thereof about the axis of said raised axle between a lowered excavating position of said cutter bar and a raised transport position thereof.

4. The portable trencher of claim 3 wherein said last named means includes a U-shaped support arm the aft free end of whose upper limb is journalled on said raised axle and the aft free end of whose lower limb is rigidly mounted to said driving and support unit suspending the same to intersect the dolly wheel axis; and operator controlled actuator means interconnecting the forward, bight end of said U-shaped support arm and the forwardly extending operator handle on said dolly for selectively controlling said arcuate positioning of said trencher.

5. The portable trencher of claim 4 wherein the rigid mounting of said lower limb to said driving and support unit includes detachable fastener means; and means, including said detachable fastener means, for maintaining said crossbar handle of said driving and support unit in stabilizing engagement with said raised axle.

6. The portable trencher of claim 4 wherein said power transmission means includes an internal combustion engine as a power source and a gear reducer; an intake filter for said power source mounted to said dolly remote from said exhaust housing and hose connected with the air intake of said engine.

7. The portable trencher of claim 6 including series connected intake filters wherein the hose connection of the engine air intake is via a second filter whose sole intake is from said remote filter.

* * * * *